US005341526A

United States Patent [19]

Kennedy

[11] Patent Number: 5,341,526

[45] Date of Patent: Aug. 30, 1994

[54] PERSONAL HYGIENE CARE UNIT

[76] Inventor: Linda J. Kennedy, P.O. Box 101, Paden, Okla. 74860

[21] Appl. No.: 972,223

[22] Filed: Nov. 5, 1992

[51] Int. Cl.[5] ..... A47K 3/062

[52] U.S. Cl. ..... 4/584; 4/585; 4/455; 4/457; 5/455; 5/462

[58] Field of Search ..... 4/584, 585, 586, 516, 4/517, 518, 567, 571.1, 572.1, 573.1, 575.1, 547; 5/455, 462

[56] References Cited

U.S. PATENT DOCUMENTS

| | | | |
|---|---|---|---|
| 779,576 | 1/1905 | Berryman | 5/455 |
| 2,471,302 | 7/1946 | Boward | 4/547 |
| 2,792,055 | 1/1954 | O'Neil | 5/462 |
| 4,935,971 | 6/1990 | Dunn et al. | 4/585 |
| 5,022,102 | 6/1991 | Louvaris | 4/585 |
| 5,025,515 | 6/1991 | Rhines | 4/584 |

*Primary Examiner*—Henry J. Recla
*Assistant Examiner*—Greg Vidovich

[57] ABSTRACT

An apparatus for the hygiene care of a person confined to a bed, comprising an inflatable tub with two cavities therein that is easily placed under a person and inflated. The device is equipped with separate drains and aprons which create pockets that contain disposable waste water bags which retrieve all waste water from the bed. The inflatable bed is supplied with water and air from a free-moving service apparatus. The inflatable bed and service apparatus are integral parts and together provide a practical and convenient method to administer personnel hygiene care to a person confined to a bed.

4 Claims, 4 Drawing Sheets

PERSONAL HYGIENE CARE UNIT

BACKGROUND OF THE INVENTION

1. Field of the Invention

The present invention relates to the field of personal health care equipment. It is meant to provide a more practical and convenient way to thoroughly meet the hygiene needs of a person confined to a bed.

2. Description of the Prior Art

The personal hygiene of a person confined to a bed currently consists of sponge baths and whirlpools. Sponge baths have no means of shampooing. Sponge baths are appreciated, but many people complain, as do their families, that this method of bathing is not satisfying. Many people confined to bed state that being bathed well and/or having a shampoo would cause them to feel refreshed mentally and physically, (a good attitude may be conducive to the healing process). They also complain that it is difficult to get a hair-dresser or other professional to come to an individual's home, a rest home, or a hospital. One problem for professionals is inaccessibility of facilities for people confined to a bed. An example is, in home care, rest homes, and hospitals usually have bathrooms with showers, tubs, and sinks, but no practical access for bed-ridden persons. Whirlpools when available, do provide good hygiene care, but due to the fact that it requires at least two staff members to transport a person from one location to another, this proves to be time consuming and often endangers the patient as well as the attending staff.

The Prior Art shows certain apparatus for bathing and/or shampooing, such as described in U.S. Pat. Nos. 4,935,971, 4,998,302, 3,694,926, 5,022,102, 5,014,471, 4,151,618, 4,660,233. While all these patents do exist and some may have been manufactured and marketed, all have been somewhat disappointing because of their impracticality and inconvenience to both the professional and the person confined to a bed.

SUMMARY OF THE INVENTION

Accordingly, the object of the present invention is to provide a more accessible and practical means of personal hygiene care of an individual confined to a bed, therefore, reducing the risk of infection and injuries, while meeting many different health and hygiene needs. It is simple, thorough, fast, safe, and convenient for both the professional and the individual.

Another object of consideration is that colleges throughout the United States are now encouraging students to enter the field of Geriatrics, predicting that in the next decade, the need for trained professionals in this field will accelerate due to the previous Baby Boom Era. Since there will be more elderly in the United States, unfortunately, there will also be more individuals confined to bed, proving that there will be an even greater need for the present invention.

With these objectives in view, the use of the inflatable together with the free-moving servicing apparatus, as integral parts of the present invention accommodates a method of personal hygiene. While deflated, the inflatable tub is easily placed on a bed underneath a person, then inflated around the person to eliminate the need for moving that individual. After inflation is completed, the aprons which hang downward over the sides of the bed mattress may be folded upward and secured to form pockets which hold the disposable waste water bags therein. Any hygiene process may begin after the waste water bags are secured into place. The water temperature can be controlled for hygiene needs or an individual's comfort. Water may be sprayed directly onto a person from the free-moving servicing apparatus or can be contained in the inflatable tub by drain seals. After bathing, shampooing, shaving, and/or any hygiene is completed, the freemoving servicing apparatus may be used to dry the individual's hair and/or body. The waste water bags can then be sealed and disposed of, or emptied and placed into a waste receptacle. Lastly, the inflatable tub and bowl device is easily deflated, sanitized, and stored. The present device provides a safe, thorough, and convenient method for hygiene care.

PREFERRED EMBODIMENT

Figure 4:
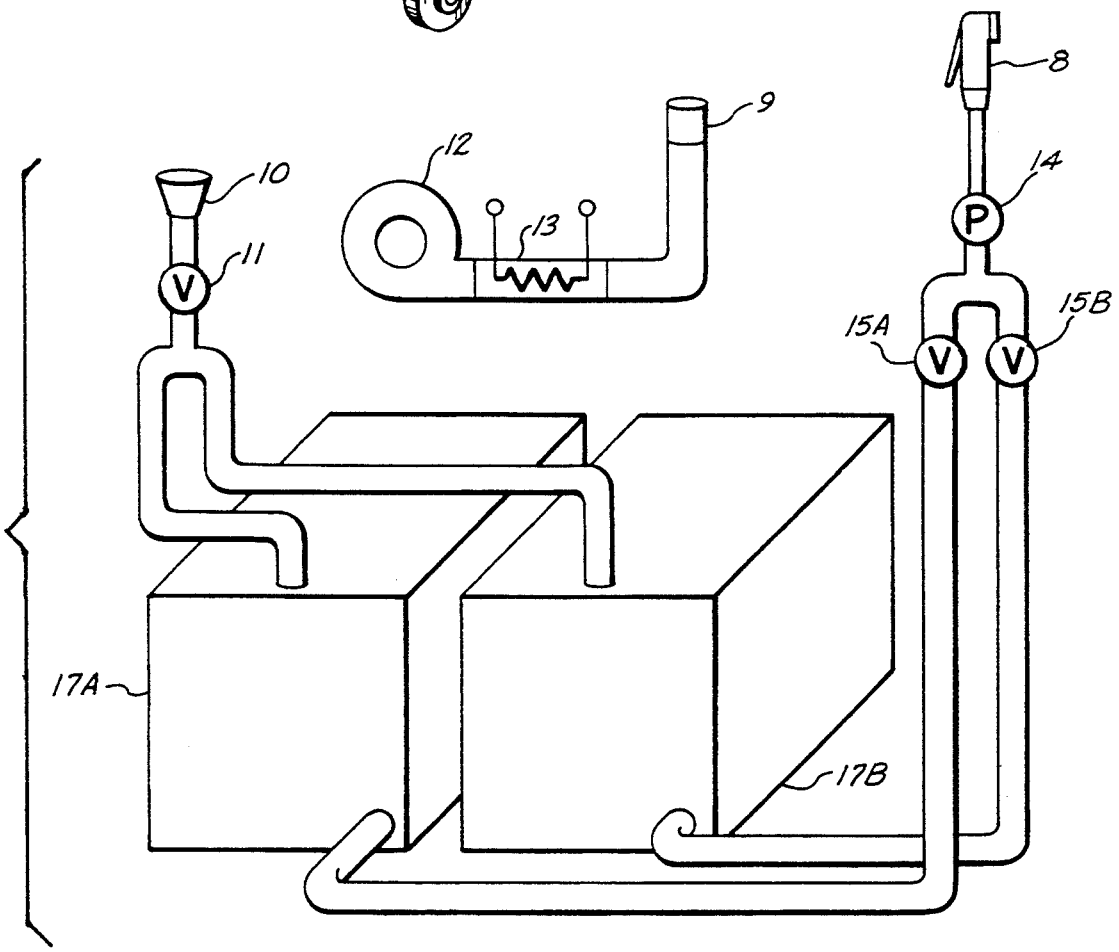
FIG. 4 is an exploded view of the internal components of said apparatus in FIG. 3.
Figure 5:
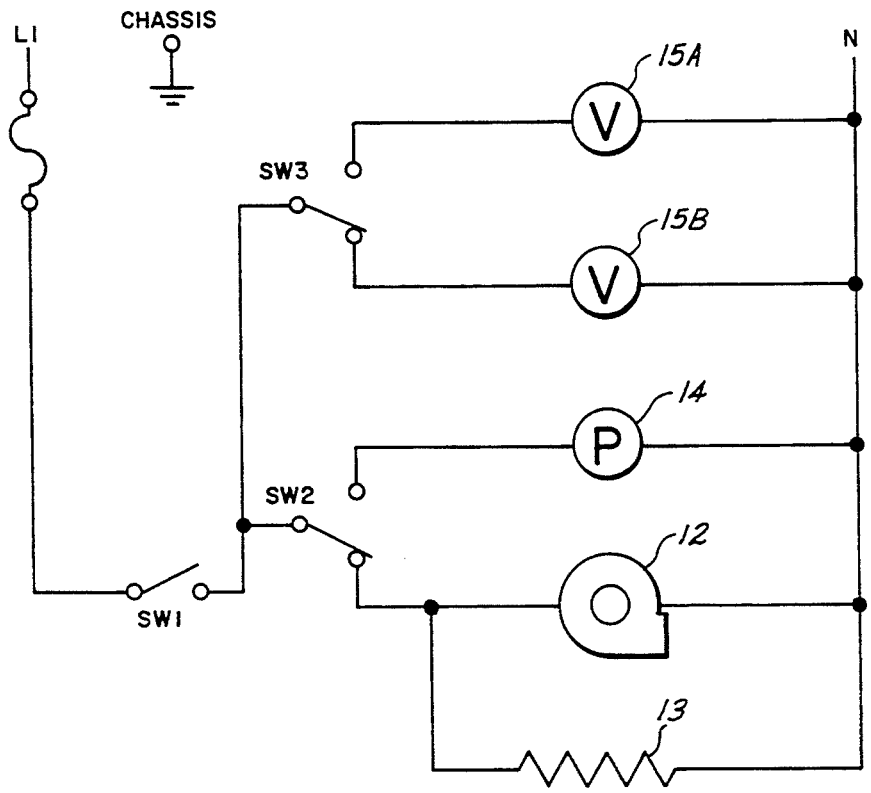
FIG. 5 is an electrical schematic diagram of internal components of said apparatus in FIG.3.

The internal components of one embodiment of the free-moving servicing apparatus of this invention are shown in FIG. 4 to comprise of two hollow tanks 17A and 17B constructed of easily sanitized material serving the purpose of hot and cold fresh water supply tanks. A pump 14 is supplied for movement of water from said supply tanks 17A and 17B to the individual being bathed via hoses and hand held sprayer 8. Valves 15A and 15B are supplied to separate and restrict the flow of hot and cold water to regulate the temperature of bathing water. Supply tanks 17A and 17B are filled using filler hose 10. Filling of the hot or cold supply tanks is selected by a mixer valve 11. The blower 12 pushes air over electric heater 13 which is heated then travels through hose 9 and can be used to inflate tub and bowl device FIG. 1 or to dry the individual being bathed.

Figure 3:
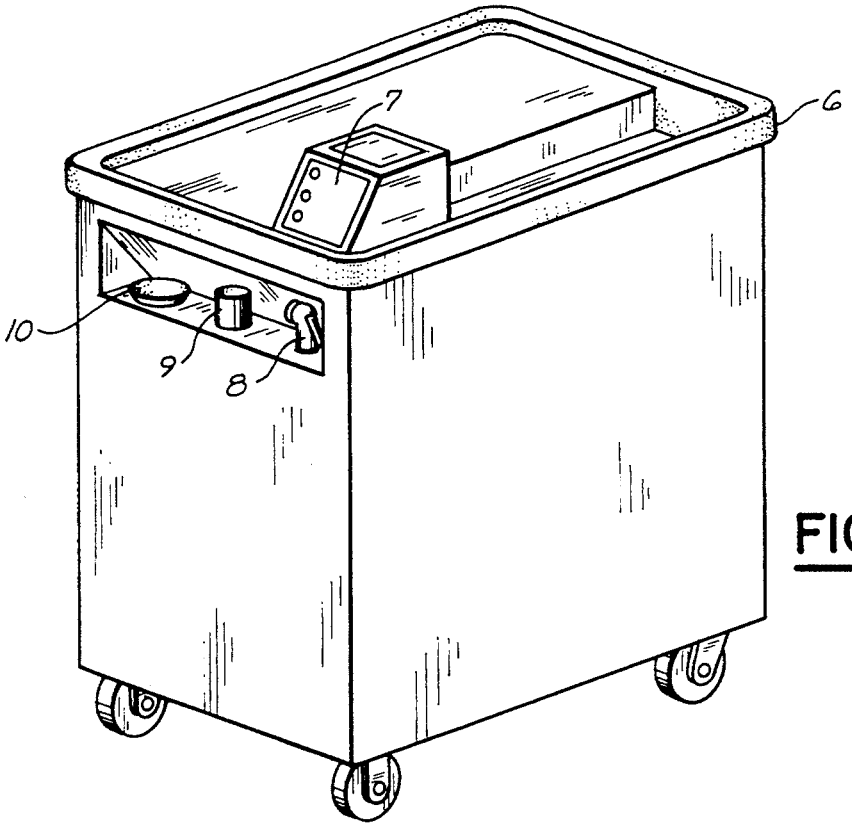
FIG. 3 is a front isometric view of one embodiment of the freemoving servicing apparatus of the present invention.

One embodiment of the free-moving servicing apparatus FIG. 3 comprises of the internal components depicted in FIG. 4 enclosed by a cabinet having casters or wheels, a control panel 7, and a handle or handrail 6. Although many options are available, such as touch pads, digital displays and push buttons, one embodiment of the control panel 7 is comprised of three switches: the main switch (on & off), one switch to select wash or air, and one switch to select hot or cold water fill.

Figure 1:
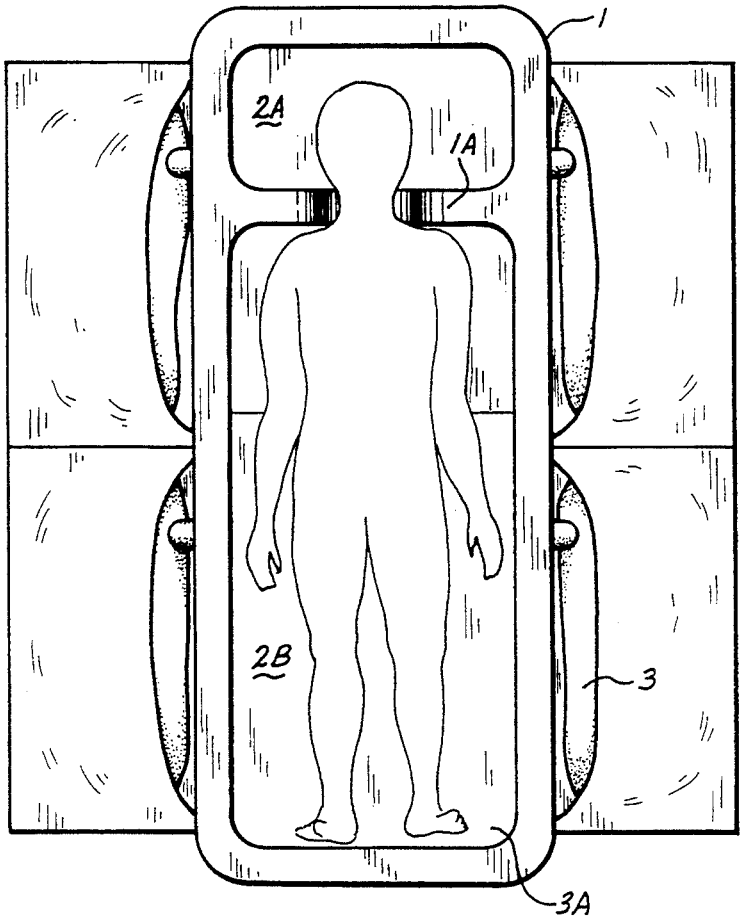
FIG. 1 is a top plan view of one embodiment of the inflatable personal tub and bowl device of the present invention.
Figure 2:
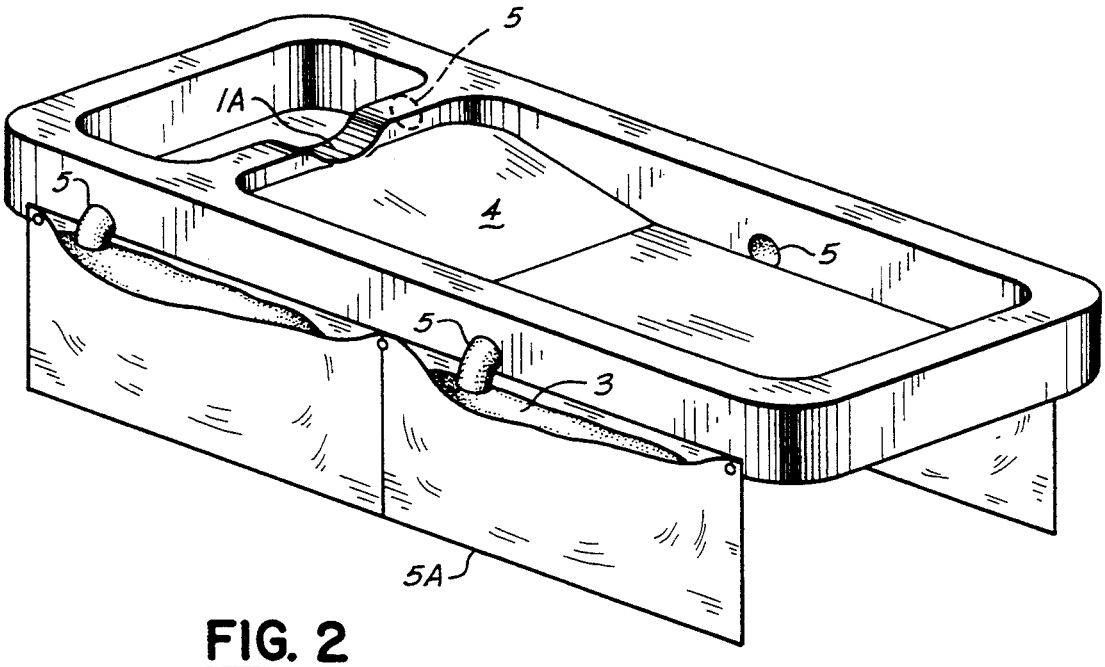
FIG. 2 is a side isometric view of said inflatable personal tub and bowl device.
Figure 6:
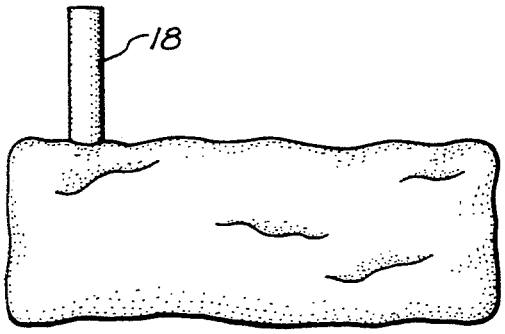
FIG. 6 and 7 are illustrative views of disposable waste water bags used in receiving and containing waste water from the inflatable personal tub and bowl device in FIG. 1.
Figure 7:
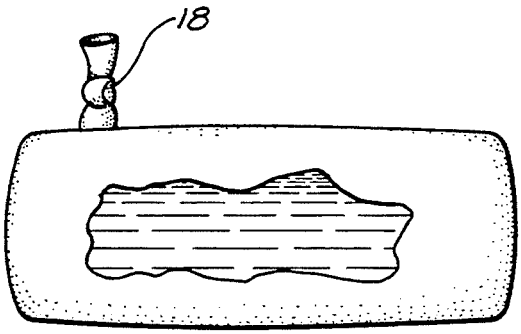
Figure 8:
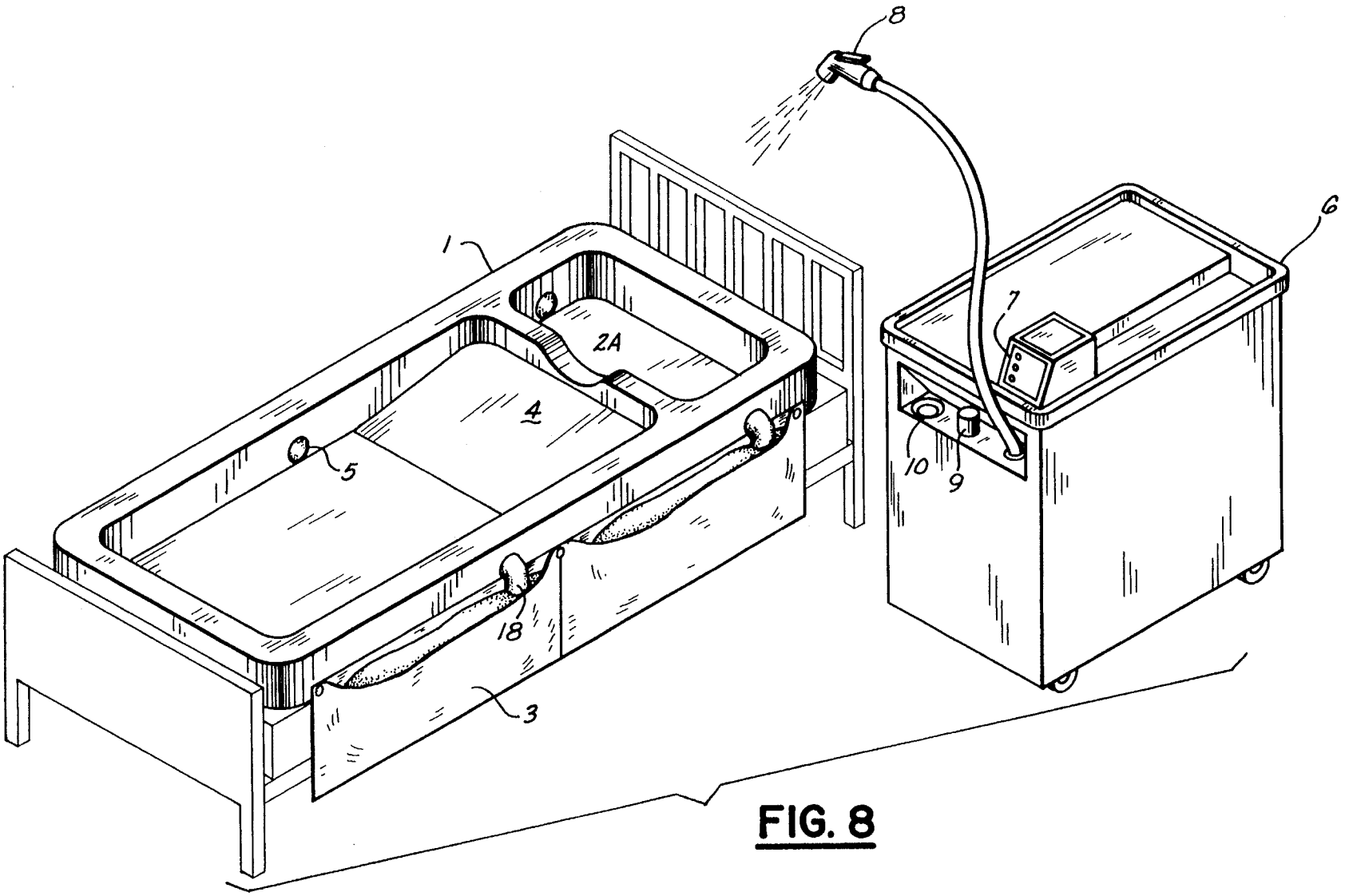
FIG. 8 is an illustrative view of said inflatable personal tub and bowl device in FIG. 3 shown together as integral parts of the present invention.

Although many options in design are available, one embodiment of the inflatable tub as seen in FIG. 1 consists of integrally connected inflatable walls 1 of flexible air-tight and water-proof material forming the inflatable tub. The device is inflated through one of two sealable openings 4A (only one shown) located on the outer side walls. The walls include a bottom wall 3A, side wall means 1 connected to and extending upwardly from around the periphery of said bottom wall 3A to form a tub shaped enclosure therein and a neckrest wall 1A connected to the bottom wall 3A. Neck rest wall 1A separates the tub shaped enclosure into a head cavity 2A and a shoulder and lower body cavity 2B. A backrest wall 4 is provided which attaches to the neckrest wall 1A and bottom wall 3A. While deflated the personal tub and bowl device is easily placed on a bed and underneath a person. It may then be inflated with warm air via hose 9. The bottom wall 3A extends on both sides of the tub and bowl device, FIG. 1, far enough to fold over and create pockets 5A for the enclosure and support of the disposable waste water bags 3. This is done after inflation is completer and opening 4A is sealed. The waste water bags, FIG. 6 and 7, are comprised of a transparent, watertight material with a flexible, elongated opening 18 and serves the purpose of receiving and containing waste water from the inflatable tub after bathing an individual. The disposable waste water bags 3 connect to the cavity drains 5 via the elongated opening of the bag 18. After disposable waste water bags 3 are in place, hygiene may then be administered. The water temperature is regulated with valves 15A and 15B and can be sprayed directly onto an individual via hoses and hand held sprayer 8. After the waste water bags have been filled, the openings 18 can be easily sealed and the bags removed for quick and safe disposal of the waste water. When bathing, shampooing, and/or any hygiene care is completed, hose 9 may be used to dry an individual's hair and/or body. After drying is complete, the inflatable tub and bowl device FIG. 1 is easily deflated, sanitized, and stored.

I claim:

1. An apparatus for personal hygiene care of a person confined to a bed comprising disposable waste water bags, a mobile service station and an inflatable tub adapted to receive said person in a supine position, said inflatable tub comprising a bottom wall and two inflatable end walls connected by two inflatable side walls, said side and end walls connected to and extending upwardly from around the periphery of said bottom wall to form a tub shaped enclosure therein when said side and end walls are inflated, each of said side walls further including apron means connected proximate the bottom of each of said side walls, each of said apron means comprising a first longitudinal edge connected to said side wall and a second longitudinal edge comprising attachment means for connecting said second longitudinal edge to said first longitudinal edge thereby forming a cavity to hold said waste water bags therein, said waste water bags being disposed in each of said apron means and including means for collecting waste water from said tub.

2. The apparatus of claim 1 wherein said mobile service station consists of:

wheels attached to the bottom of said station to provide mobility of said station;

hot and cold water supply tanks located within said station for supplying bath water to said tub;

water pump means located within said station connected to said tanks to supply water pressure to the tanks;

valve means connected to said hot and cold water supply tanks to regulate water flow and temperature of bathing water exiting said tanks;

a hand held spray device located externally said service station with connection means for connecting said spray device to said valve means for spraying said person;

an air blower located within said station and having heating means to heat air;

an air hose connected to said air blower and having means for connecting to said side walls for inflating said tub and also for drying said person; and a control panel means located on said station which controls said water pump means, said valve means, and said air blower.

3. The apparatus of claim 1 wherein said inflatable tub consists of two cavities, one of said cavities formed to receive the head of said person, and the other of said cavities formed to receive the shoulders and lower body portion of said person, said tub further consisting of wall means between said two cavities for supporting the neck of said person.

4. The apparatus of claim 1 wherein the waste water bags are formed of a disposable, water-proof material and said collecting means comprise flexible elongated tubes integral with said bag.

* * * * *